US006511582B2

(12) United States Patent
Westerkamp

(10) Patent No.: US 6,511,582 B2
(45) **Date of Patent: *Jan. 28, 2003**

(54) PAPER MACHINE WIRE FOR THE WET END SECTION OF A PAPER MACHINE

(75) Inventor: Arved H. Westerkamp, Heidenheim (DE)

(73) Assignee: Voith Fabrics Heidenheim GmbH & Co., KG (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 78 days.

(21) Appl. No.: 09/470,339

(22) Filed: Dec. 22, 1999

(65) Prior Publication Data

US 2002/0060057 A1 May 23, 2002

(30) Foreign Application Priority Data

Dec. 22, 1998 (DE) ..... 198 59 583

(51) Int. Cl.[7] ..... D21F 1/10

(52) U.S. Cl. ..... 162/348; 162/351; 162/358.1; 162/358.2; 428/229; 428/234; 428/235; 428/257; 428/247; 139/383; 139/420; 442/270

(58) Field of Search ..... 162/348, 351, 162/358.1, 358.2; 139/383, 420, 426; 442/270; 428/229, 234, 235, 257, 247

(56) References Cited

U.S. PATENT DOCUMENTS

| | | | | |
|---|---|---|---|---|
| 3,657,068 A | * | 4/1972 | Ivanowicz | 162/358 |
| 4,259,394 A | * | 3/1981 | Khan | 428/229 |
| 4,467,839 A | * | 8/1984 | Westhead | 139/383 |

* cited by examiner

*Primary Examiner*—Stanley S. Silverman
*Assistant Examiner*—Mark Halpern
(74) *Attorney, Agent, or Firm*—Gifford, Krass, Groh, Sprinkle, Anderson & Citkowski, P.C.

(57) ABSTRACT

The invention relates to a paper machine wire for the wet end section of a paper machine, comprising a textile or non-texile fabric, especially a woven fabric, the one side of which is directed to the paper and the other, opposite side of which is directed to the paper machine, the one side of the fabric directed to the paper being at least partly covered by a fiber layer. The fiber layer is permanently compressed in some regions less intensively than in other regions.

20 Claims, 1 Drawing Sheet

PAPER MACHINE WIRE FOR THE WET END SECTION OF A PAPER MACHINE

BACKGROUND OF THE INVENTION

The invention relates to a paper machine wire for the wet end section of a paper machine, having a textile or non-textile fabric, particularly a woven fabric, the one side of which is directed to the paper and the other, opposite side of which is directed to the paper machine wherein the one side of the fabric, which side is directed to the paper, is at least partly covered by a fiber layer.

Such paper machine wires which may be manufactured in the form of a single or a multiple layer or in the form of a composite woven fabric and which generally comprise a woven or non-woven, textile or non-textile fabric, particularly a woven fabric, are known in practice. These fabrics serve for dewatering an aqueous fiber suspension and for guiding this suspension to the press section of the paper machine.

The known paper machine wires of all kinds of design are characterized by the fact that the side of the wire directed to the paper is determined by the structure given by the weave of the woven fabric. The surface structure of the woven fabric shall indicate on the paper as few marking as possible. Thus, there is a particular demand for a reduced topographical marking of the wire due to the sensitive paper types. With the known paper machines the retaining capability, also called retention, required by the paper manufacturer is often not sufficient with respect to fibers as well as auxiliary and additional material. Moreover, a washing out may occur starting from the running or wearing side of the woven fabric caused by the dewatering and guide elements of the paper machine, said washing out also leading to low retention values.

A paper machine wire, also called paper machine forming fabric, according to the preamble of claim 1, comprising a textile fabric having the form of a woven fabric is known from U.S. Pat. No. 5,077,116. The fiber layer, also called fiber batt, is formed by individual fibers and is loosely put on the surface of the woven fabric and connected with the threads of the woven fabric forming the surface of the woven fabric. It is shown particularly in FIGS. 5, 8, 11 and 14 that the fiber layer is adapted to the surface of the woven fabric such that the structure of the woven fabric is imitated. As a result, the surface of the fiber layer similar like the surface of the woven fabric does not form a uniform horizontal plane.

SUMMARY OF THE INVENTION

It is therefore an object of the present invention to provide a paper machine wire of the initially specified kind according to which the topographical marking tendency is reduced to a minimum.

It is a further object of the present invention to provide a paper machine wire, the retention values of which are amended regarding the paper production.

These and other objects are accomplished according to the present invention by providing a paper machine wire comprising a fiber layer which is permanently compressed in some regions less intensively than in other regions. According to the present invention the fiber layer is less intensively compressed in those regions where corresponding regions of the surface of the side of the textile or non-textile fabric directed to the paper lies in a plane mainly forming the surface of the fabric. Therefore, the fiber layer has a complete uniform, smooth surface. Moreover, the permeability of the fiber may be adjusted by the orientation of the fibers and the structure of the fiber layer. As a result, the paper manufactured by such a paper machine wire is practically free from any marking and therefore satisfies the highest requirements. As a further result the retaining capability with respect to the fibers and the auxiliary as well as additional materials of a fiber suspension may extensively be adjusted depending on the density or the pore size of the selected fiber. This is also true regarding the ability of the fiber layer to dewater the fiber suspension.

Preferred embodiments of the invention are mentioned in the subclaims.

According to an advantageous further embodiment the fiber layer has a thickness of preferably 0.1 to 1 mm as well as a substantially uniform permeability. The mentioned thickness of the fiber layer increases the total thickness of the paper machine wire by a delimited extent. A uniform permeability of the fiber layer further enables a uniform dewatering of the fiber suspension and, therefore, a substantially homogeneous consistency of the fibers guided to the wet end section, also simply called wet end, of the paper machine.

According to another embodiment of the present invention the fiber layer is made of plastic, fusible fabrics, such as for example polyethylene terephthalate, polyamide, polyethylene, polypropylene, polybutylene terephthalate and combinations of the aforementioned materials. Those plastic fibers enable, as discussed hereafter, a thermal treatment and, therefore, an easy depositing of the fiber layer on the upper side of the textile or non-textile fabric.

It is further advantageous that the surface of the fiber layer is permanently topographically structured preferably by circular, triangular, rectangular depressions or by depressions formed in another way or that the surface of the fiber layer is produced with hydrophilic, hydrophobic or antistatic or stain releasing properties by means of physical or chemical surface treatment methods. The selected topographies may be realized according to the desire of the paper manufacturer by a simple configuration of the surface of the fiber layer on the paper independently from the structure of the fabric. It is therefore possible to provide predetermined patterns on the paper by correspondingly forming the fiber layer independently from the structure of the fabric. Thus, the structure of the paper may be configured in at least any manner.

According to a further embodiment of the present invention the fiber layer is penetrated by pores which may taper or widen toward the fabric. Particularly the retaining capability of the total paper machine wire as well as the three dimensional dewatering characteristic may be adjusted as desired by the pore size or a pore size range, and the retaining capability and the dewatering characteristic may be adapted to the size of the fibers which are to be retained.

It is further advantageous that the textile or non-textile fabric has on its paper directed side fibers or threads, also called yarns, which have the capability of being permanently attached to the fiber layer, wherein the fibers or threads are preferably made of plastic fusible fibers, such as polyethylene terephthalate, polyamide, polyethylene, polypropylene, polybutylene terephthalate and combinations of the aforementioned materials. As a result, fibers or threads of the fabric and the material of which the fiber layer is made, may at least partly be identical and, therefore, may easily permanently attached to each other.

According to a further embodiment of the present invention the fiber layer is fixed on the fabric by a bonding agent preferably a hot melt glue. The fiber layer may particularly perform a permanent bonding with the fabric by means of a heat-pressure-treatment, wherein the temperature is between about 170 and 270° C. and the line pressure is between about 10 and 50 N/mm depending on the selected materials. According to a another embodiment of the present invention the fiber layer is permanently fixed on the textile fabric by ultrasonics, the welding frequency being between 15 and 72 MHz, preferably between 15 and 35 MHz. The advantage of the above mentioned method lies in the fact that the materials partly dissolve in each other such that a close bonding between the fiber layer and the textile or non-textile fabric is performed. The advantage of the above mentioned ultrasonic method mainly lies in the fact that only the direct welding joint is heated whereas the surroundings of the welding joint remain cold. The fiber layer may purposefully be deposited on the surface of the fabric thereby and may be attached thereto. Non-desired thermal deformations or thermal decompositions due to a too high temperature occur less often and are restricted to certain regions.

According to still a further embodiment the covering ratio between the fiber layer and the side of the fabric directed to the paper is more than 40%. This enables a slower and, therefore, more carefull dewatering of the fiber suspension compared to a less covered surface of the textile or non-textile fabric.

BRIEF DESCRIPTION OF THE DRAWINGS

The invention will be described below with reference to embodiments thereof as illustrated in the drawings. In the drawings.

DESCRIPTION OF PREFERRED EMBODIMENTS OF THE INVENTION

Figure 1:
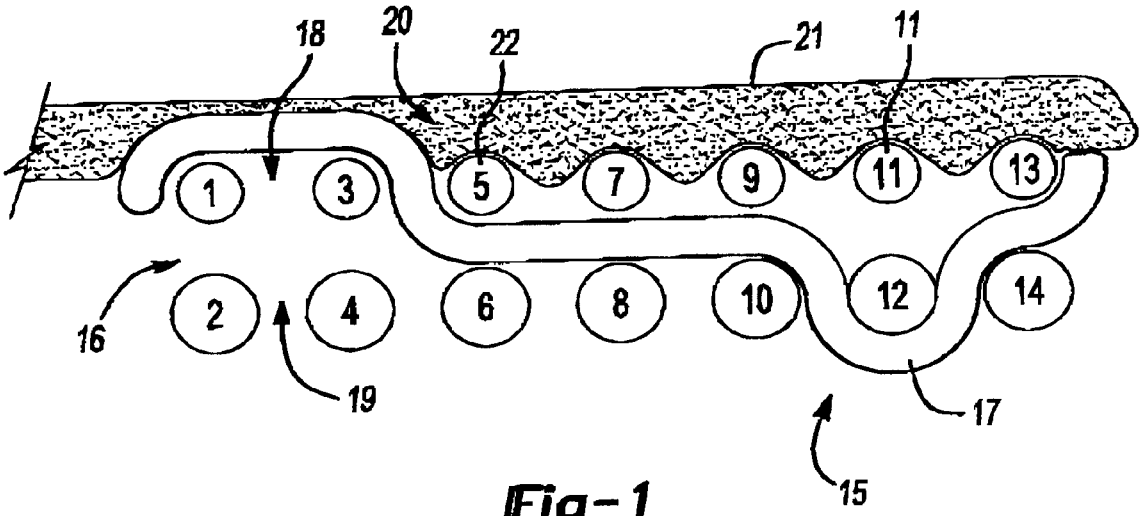
FIG. 1 is a schematic longitudinal sectional view of a part of a paper machine wire according to a first embodiment of the present invention.

FIG. 1 shows a schematic longitudinal section, also called weft section, through a part of a paper machine wire 15 for the wet end section of a not shown paper machine. The paper machine wire 15 comprises a textile or non-textile fabric 16 in the form of a woven fabric having an upper layer of weft threads 1, 3, 5, 7, 9, 11 and 13 directed to the paper (not shown) as well as a lower layer of weft threads 2, 4, 6, 8, 10, 12 and 14 directed to the paper machine. It is to be noted that the fabric may be of a woven or non-woven type and, therefore, is formed as a woven fabric only by way of example.

Figure 2:
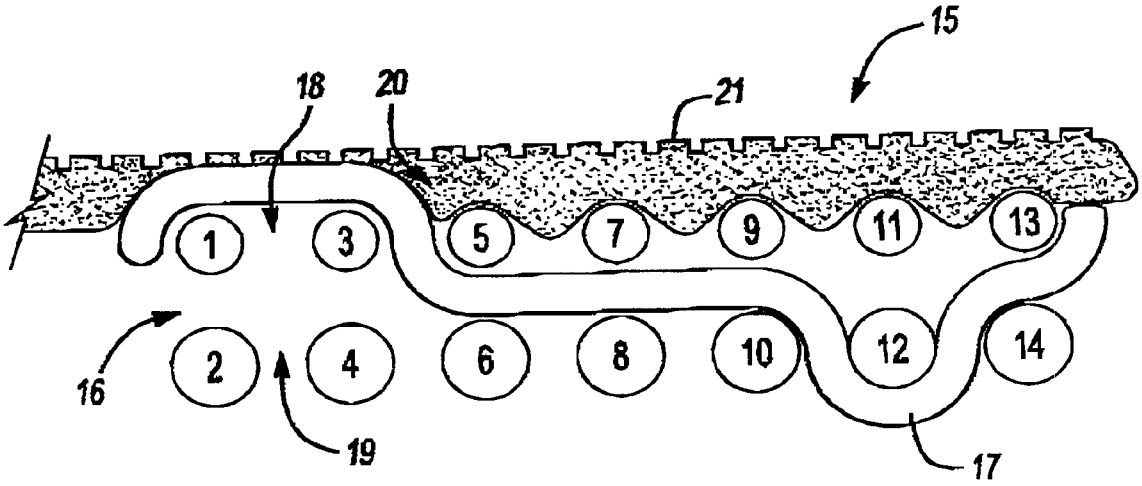
FIG. 2 is a schematic longitudinal sectional view of a part of a paper machine wire according to another embodiment of the present invention.

Furthermore, the woven fabric 16 comprises several warp threads 17, of which only one warp thread is shown in FIGS. 1 and 2, said warp thread connecting the upper layer of weft threads and the lower layer of weft threads.

According to FIG. 1 this shown warp thread 17 extends depending on the weave pattern partly above the weft threads 1 and 3 of the upper layer, partly between the weft threads of the upper layer and the lower layer, namely between weft threads 5 and 6, 7 and 8, 9 and 10, partly beneath at least one weft thread of the lower layer, in the selected embodiment beneath weft thread 12, and partly again between the layers of the weft threads, namely between weft thread 13 of the upper layer and weft thread 14 of the lower layer. The one side 18 having the weft threads of the upper layer of the fabric formed as a woven fabric is directed to the paper, the opposite, other side 19, namely the lower layer of the weft threads, is directed to the not shown paper machine. In general, any single-layered or multilayered structure, particularly woven structure, may be used as a base structure depending on the use purpose.

According to the present invention a fiber layer 20 is provided on the one, upper side 18 of the woven fabric, the fiber layer at least substantially or at least nearly completely covering this one side of the woven fabric. The upper side 18 is completely covered by the fiber layer in the Figures. The fiber layer may generally also be called non-woven structure.

The paper contacting layer formed by the fiber layer 20 accommodating the aqueous fiber suspension, preferably has a fiber bearing and dewatering function. The layer which is formed by the woven fabric 16, directed to the paper machine and in contact with the paper machine represents the wearing volume of the wire and further supports the dewatering of the fiber. So to speak, the woven fabric 16 forms the force supporting layer of the paper machine wire 15, the layer moving over not shown stationary or moving elements of the paper machine and protecting the fiber layer 20 against a direct contact with the paper machine and, thus, against wearing.

The fiber layer 20 is permanently compressed and has a thickness of preferably 0.1 to 1 mm as well as a substantially uniform permeability. As may be seen from FIGS. 1 and 2 and according to the shown embodiments of the present invention the fibers of the fiber layer are less compressed within the region of weft threads 5, 7, 9, 11 and 13 of the upper layer of the woven fabric 16 than in the region above warp thread 17 and the weft threads 1 and 3 of the upper layer. It is apparent that warp thread 17 is closer disposed to weft threads 1 and 3 of the upper layer in practice and, if at all only insignificantly extends over the plane formed by the weft threads 5, 7, 9, 11 and 13 of the upper layer. It is to be noted that the illustrations of FIGS. 1 and 2 are schematically simplified and not absolutely designed in correct scale.

According to the Figures the surface of the textile or non-textile fabric lies in different planes. The fiber layer finally compensates these different planes by the above mentioned different compression such that the surface of the fiber layer is completely smooth and even. In other words, the fiber layer is therefore less compressed in those regions where the corresponding regions of the surface of the side 18 of the fabric directed to the paper is located in a plane mainly forming the surface of the fabric. Thus, the fiber layer is more compressed in those regions where some threads, in FIGS. 1 and 2 warp thread 17, arise above this plane. This is the cage in FIGS. 1 and 2 in the region above weft threads 1 and 3.

The predescribed permanent compression of the fiber layer may for example be performed in that this layer is subjected to a temperature of 170 to 270° C. and a line pressure of about 10 to 50 N/mm in a calendering device between two rollers rotating in opposite directions. The mentioned temperature and pressure ranges are dependent from the used materials.

Preferably, the fiber layer 20 ist made of plastic fasible fibers such as polyethylene terephthalate, polyamide, polyethylene, polypropylene, polybutylene terephthalate as well as combinations of the aforementioned materials. According to the first embodiment shown in FIG. 1 the surface 21 of the fiber layer 20 is formed like a smooth plane, whereas according to the second embodiment shown in FIG. 2 the surface of the fiber layer is additionally permanently topographically structured in the form a line structure or in the form of square depressions. This configuration may also include circular, triangular or rectangular or generally polygonal depressions or other forms (not shown). The selection of the topographic structure is adapted to the use purpose. The predescribed circular depressions may for example have a diameter of 0.1 to 3.5 mm. Depressions in the form of isosceles triangles have for example a lateral side length of 0.1 to 3.5 mm Also the outer length comprising a rectangular, particularly square, form may be 0.1 to 3.5 mm. The mentioned depressions may have a length of up to 80% of the total thickness of the fiber layer.

According to a particular embodiment of the present invention the fiber layer is penetrated by pores. These pores may completely extend through the total fiber layer and may taper or widen for example toward the woven fabric 16.

According to a further embodiment of the present invention the surface 21 of the fiber layer 20 has hydrophilic, hydrophobic, anti-static or stain releasing properties by means of physical or chemical surface treatment methods. This may for instance be realized by depositing suitable chemical agents in the form of a foam or by means of dipping methods. It is apparent that the surface charge potentials of the fiber layer are to be harmonized with those of the fiber suspension.

According to a further preferred embodiment of the present invention the woven fabric 16 comprises on its one side 18 which is directed to the paper, threads which are in a position to form a permanent attachment with the fiber layer 20. This is shown in FIG. 1 for example with respect to weft threads 5 and 11 of the upper layer which are permanently attached to the fiber layer 20 in the respective upper regions 22.

Those threads may be made or manufactured of monofil, multifil, coated or also so-called mantle-core- (two component-) threads made of polyethylene terephthalate, polyamide of the types 6.0, 6.6, 6.10, 6.12, polyethylene, polypropylene, polybutylene terephthalate as well as combinations of the aforementioned materials.

The fiber layer 20 preferably covers the complete surface of the woven fabric 16 such that a new, uniform plane having for instance a structured, permeable surface 21 is formed. It is further important that the fiber layer 20 is attached to the surface of the underlying woven fabric and covers the structure of the woven fabric such that the topography of the fiber layer is finally directed right next to the fiber suspension to be dewatered. The newly formed surface 21 of the fiber layer as well as the permeability of the total paper machine wet 15 may be controlled for instance by the fiber orientation of the fiber layer as well as the structure thereof.

Die fiber layer 20 may be deposited onto the woven fabric and attached thereto by means of different methods.

It is possible to fix the fiber layer 20 on the woven fabric 16 by a bonding medium, for example a hot melt glue. This may be performed for example by a bonding fiber layer made of fusible fibers, by a connecting, fusible net structure or also in the form of a deposite layer made of a hot melt glue, wherein the bonding agent or the bonding medium may be made for example of polyethylene terephthalate, polyamide, polyethylene, polypropylene, polybutylene terephthalate or combinations of the aforementioned materials.

It is further possible that the fiber layer 20 is permanently attached to the woven fabric 16 by a heat-pressure-treatment, wherein the temperature is between about 170 and 270° C. and the line pressure is between about 10 and 50 N/mm dependent from the selected materials and wherein the time period is selected in such a way that the melting on of the fiber layer as well as of the upper layer of the woven fabric is reached. It is apparent that the selected temperatures are within the range of the melting points of the used materials. It is further advantageous to adapt the material used for the fiber layer especially regarding the respective melting points to the material of the layer of the woven fabric 16 being in contact with the fiber layer. In this case the woven fabric may for example be made of polyethylene terephthalate/polypropylene, and the fiber layer may for example be made of polypropylene. It is further possible that the surface of the fabric is made of two-component-fibers or mantle-core-fibers.

It is further possible to permanently fix the fiber layer 20 on the woven fabric 16 by ultrasonics wherein the welding frequency is between about 15 to 72 MHz, preferably between 15 and 35 MHz, if polyester is processed preferably at 27, 12 MHz.

The fiber orientation within the fiber layer may vary in wide limits. A predetermined fiber orientation or also so-called random-orientated fibers may be applied. The fiber layer 20 may also be deposited on the woven fabric by spray-bonding.

Furthermore, the covering ratio between the fiber layer 20 and the side 18 of the fabric 16 directed to the paper may be more than 40% according to the shown embodiments wherein the speed of the dewatering process may be adjusted by the covering ratio. The higher the covering ratio, the slower and, therefore, more careful is the dewatering process of the fiber suspension.

By means of the paper machine wire structured according to the present invention the topographic marking tendency of the paper machine wet is reduced to a minimum Moreover, the retaining values of the paper machine wet during the paper production are amended.

What is claimed is:

1. A paper machine wire for the wet end section of a paper machine, said wire comprising:

a fabric having a first side directed to a paper and a second side directed to said paper machine, said fabric including at least a first and a second layer of weft threads and at least one warp thread woven between said layers of weft threads;

a fiber layer covering said fabric, said fiber layer having a bottom positioned on said fabric and a top having a uniform surface; and wherein a side of said first layer contacts said fiber layer and at least a portion of said warp thread extending along said side of said first layer between said fiber layer such that said fiber layer is more compressed in regions where the warp thread is present and is less compressed in those regions of the side of the first layer of fabric where the warp thread is absent.

2. A paper machine wire according to claim 1, characterized in that the fiber layer has a thickness of 0.1 to 1 mm and a substantially uniform permeability.

3. A paper machine wire according to claim 1, characterized in that the fiber layer comprises plastic fusible fibers.

4. A paper machine wire according to claim 3, wherein said plastic fusible fibers are taken from a group consisting of polyethylene, terephthalate, polyamide, polyethylene, polypropylene, polybutylene terephthalate and combinations thereof.

5. A paper machine wire according to claim 1, characterized in that the top of the fiber layer is permanently topographically structured.

6. A paper machine wire according to claim 1, wherein the permanently topographically structured fiber layer includes structures selected from a group consisting of circles, ovals, triangles, squares, rectangles, depressions thereof and combinations thereof.

7. A paper machine wire according to claim 1, characterized in that the fiber layer is penetrated by pores.

8. A paper machine wire according to claim 1, characterized in that the fabric comprises on said first side fibers which permanently bond with the fiber layer.

9. A paper machine wire according to claim 8, characterized in that the fibers which permanently bond with the fiber layer comprise plastic fusible fibers.

10. A paper machine wire according to claim 9, wherein said plastic fusible fibers are selected from a group consisting of polyethylene, terephthalate, polyamide, polyethylene, polypropylene, polybutylene terephthalate and combinations thereof.

11. A paper machine wire according to claim 1, characterized in that the fiber layer is fixed on the fabric by a bonding agent.

12. A paper machine wire according to claim 11, wherein said bonding agent comprises a hot melt glue.

13. A paper machine wire according to claim 1, characterized in that the fiber layer is permanently attached to the fabric by means of a heat-pressure-treatment wherein the temperature is between about 170 and 270° C. and the line pressure is between about 10 and 50 N/mm.

14. A paper machine wire according to claim 1, characterized in that the fiber layer is permanently attached to the fabric by means of ultrasonics, the welding frequency being between about 15 and 72 MHz.

15. A paper machine wire according to claim 14, characterized in that the welding frequency is between about 15 and 35 MHz.

16. A paper machine wire according to claim 1, wherein said fiber layer comprises a surface treatment.

17. A paper machine wire according to claim 16, wherein said surface treatment is selected from the group consisting of a hydrophilic, hydrophobic, anti-static or stain releasing treatment.

18. A paper machine wire according to claim 1, wherein said fiber layer covers at least 40% of said first side of said fabric.

19. A paper machine wire for the wet end section of a paper machine, said wire comprising:

a fabric having a first side directed to a paper and a second side directed to said paper machine; and a fiber layer covering said fabric, said fiber layer having a bottom positioned on said fabric and a top having a uniform surface that is permanently topographically structured.

20. A paper machine wire according to claim 19, wherein the permanently topographically structured fiber layer includes structures selected from a group consisting of circles, ovals, triangles, squares, rectangles, depressions thereof and combinations thereof.

* * * * *